US010518560B2

(12) United States Patent
Ando

(10) Patent No.: US 10,518,560 B2
(45) Date of Patent: Dec. 31, 2019

(54) THERMAL PRINTER AND PORTABLE TERMINAL

(71) Applicant: Seiko Instruments Inc., Chiba-shi, Chiba (JP)

(72) Inventor: Norihisa Ando, Chiba (JP)

(73) Assignee: SEIKO INSTRUMENTS INC., Chiba-Shi, Chiba (JP)

( * ) Notice: Subject to any disclaimer, the term of this patent is extended or adjusted under 35 U.S.C. 154(b) by 0 days.

(21) Appl. No.: 15/959,556

(22) Filed: Apr. 23, 2018

(65) Prior Publication Data

US 2018/0311978 A1 Nov. 1, 2018

(30) Foreign Application Priority Data

Apr. 26, 2017 (JP) ..... 2017-086806

(51) Int. Cl.

| | |
|---|---|
| ***B41J 11/04*** | (2006.01) |
| ***B41J 2/325*** | (2006.01) |
| ***B41J 2/335*** | (2006.01) |
| ***B41J 29/38*** | (2006.01) |
| ***B41J 29/02*** | (2006.01) |

(52) U.S. Cl.

CPC ..... *B41J 11/04* (2013.01); *B41J 2/325* (2013.01); *B41J 2/33505* (2013.01); *B41J 29/02* (2013.01); *B41J 29/38* (2013.01)

(58) Field of Classification Search

CPC ... B41J 11/04; B41J 2/32; B41J 25/312; B41J 25/304; B41J 29/02; B41J 29/38; B41J 2/33505; B41J 2/325; B41J 2202/31; B41J 25/3082; B41J 11/02; B41J 11/053; B41J 11/057; B41J 11/13; B41J 11/10; B41J 11/08; B41J 11/06

See application file for complete search history.

(56) References Cited

U.S. PATENT DOCUMENTS

| | | | |
|---|---|---|---|
| 6,183,148 | B1 | 2/2001 | Martinez et al. |
| 2015/0062280 | A1 | 3/2015 | Takabatake et al. |

FOREIGN PATENT DOCUMENTS

| | | | |
|---|---|---|---|
| EP | 0794066 | A1 | 9/1997 |
| EP | 3246168 | A1 | 11/2017 |
| EP | 3275667 | A1 | 1/2018 |
| JP | 2015-44353 | A | 3/2015 |

OTHER PUBLICATIONS

Extended European Search Report in European Application No. 18169094.2, dated Aug. 9, 2018, pp. 1-8.

*Primary Examiner* — Kristal Feggins

(74) *Attorney, Agent, or Firm* — Brinks Gilson & Lione

(57) ABSTRACT

A thermal printer includes a frame, a platen roller supported on the frame so as to be rotatable about a first direction, a head support plate supported on the frame, and a thermal head fixed to the head support plate. The head nips paper between the roller in a second direction orthogonal to the first direction. The frame includes a swing support portion supporting the plate so that the plate is swingable about the first direction and a third direction orthogonal to the first direction and the second direction. The head is fixed to a portion of the plate located on a first side in the third direction with respect to the swing support portion. Between a portion of the plate located on a second side and the frame, an urging member configured to urge the plate in a direction of causing the head to approach the roller is interposed.

4 Claims, 7 Drawing Sheets

THERMAL PRINTER AND PORTABLE TERMINAL

RELATED APPLICATIONS

This application claims priority under 35 U.S.C. § 119 to Japanese Patent Application No. 2017-086806 filed on Apr. 26, 2017, the entire content of which is hereby incorporated by reference.

BACKGROUND OF THE INVENTION

1. Field of the Invention

The present invention relates to a thermal printer and a portable terminal.

2. Description of the Related Art

Hitherto, a thermal printer has been known as a printer configured to perform printing on a recording sheet (heat-sensitive paper). The thermal printer includes a thermal head, a platen roller, and a frame. The thermal head includes heating elements. The platen roller is configured to feed the recording paper by nipping the recording paper with the thermal head. The frame is configured to support the thermal head and the platen roller.

The above-mentioned thermal head is urged by urging members toward the platen roller under a state in which the thermal head is fixed to a head support plate. With this, the thermal head is pressed against an outer peripheral surface of the platen roller with a predetermined pressing force. With this configuration, the heating elements of the thermal head are caused to generate heat as appropriate during a course of feeding the recording paper through rotation of the platen roller, thereby being capable of printing various information on the recording paper.

In order to secure print quality of the thermal printer, the heating elements is required to be arranged at a portion corresponding to a region of the outer peripheral surface of the platen roller which is squeezed by the thermal head (nip portion). Therefore, it is preferred that the nip portion have a desired width over an entirety of the platen roller in an axial direction thereof (at least an entirety of a heating portion in which heating elements are arrayed).

However, when the platen roller is supported on the frame under a state in which the platen roller is inclined in a direction of approaching or separating from the thermal head, a load which acts between the platen roller and the thermal head becomes uneven in the axial direction. As a result, the width of the nip portion is liable to become uneven in the axial direction. Specifically, when the width of the nip portion becomes larger than the desired width, friction resistance generated among the platen roller, the thermal head, and the recording paper becomes larger. As a result, a load which acts on a motor configured to drive the platen roller becomes larger. When the width of the nip portion becomes smaller than the desired width, contact between the recording paper and the heating elements becomes insufficient. As a result, there is a fear in that print failure (for example, blur) occurs.

There is a case in which the platen roller is held by a positioning mechanism (lock arm) under a state in which the platen roller is received in roller receiving grooves formed in the frame. In such a case, positioning of the platen roller with respect to the frame is reliably performed, and hence it is conceivable that the above-mentioned inclination is less liable to occur. However, when the positioning mechanism is provided, there is a fear of causing increase in cost and increase in complexity of configuration.

In view of the circumstance described above, for the thermal printer of this type, there has been a demand for improving the print quality while achieving reduction in cost and simplification of configuration.

SUMMARY OF THE INVENTION

According to one embodiment of the present invention, there is provided a thermal printer, including: a frame; a platen roller, which is supported on the frame so as to be rotatable about a first direction, and includes a transmission portion configured to receive power transmitted from a drive source at an end portion on a first side in the first direction; a head support plate, which is supported on the frame; and a thermal head, which is fixed to the head support plate, and is configured to nip recording paper between the thermal head and the platen roller in a second direction orthogonal to the first direction to perform printing on the recording paper, wherein the frame includes a swing support portion configured to support the head support plate so that the head support plate is swingable about the first direction and a third direction orthogonal to the first direction and the second direction, wherein the thermal head is fixed to a portion of the head support plate located on a first side in the third direction with respect to the swing support portion, and wherein an urging member configured to urge the head support plate in a direction of causing the thermal head to approach the platen roller is interposed between a portion of the head support plate located on a second side in the third direction with respect to the swing support portion, and the frame.

In the above-mentioned thermal printer according to the one embodiment of the present invention, wherein the frame includes: a base portion; and the swing support portion, which protrudes in the second direction from a portion of the base portion located on a side opposite to the platen roller over the head support plate, and wherein a relief portion for avoiding contact between the head support plate and the base portion along with swinging of the head support plate about the third direction is formed at a portion of the frame located at least on the first side in the first direction with respect to the swing support portion.

In the above-mentioned thermal printer according to the one embodiment of the present invention, wherein a length of the swing support portion in the first direction is set equal to or larger than a half of a length of the head support plate in the first direction.

According to one embodiment of the present invention, there is provided a portable terminal, including: the thermal printer of claim 1; and a casing to which the thermal printer is mounted.

DETAILED DESCRIPTION OF THE EMBODIMENTS

Figure 1:
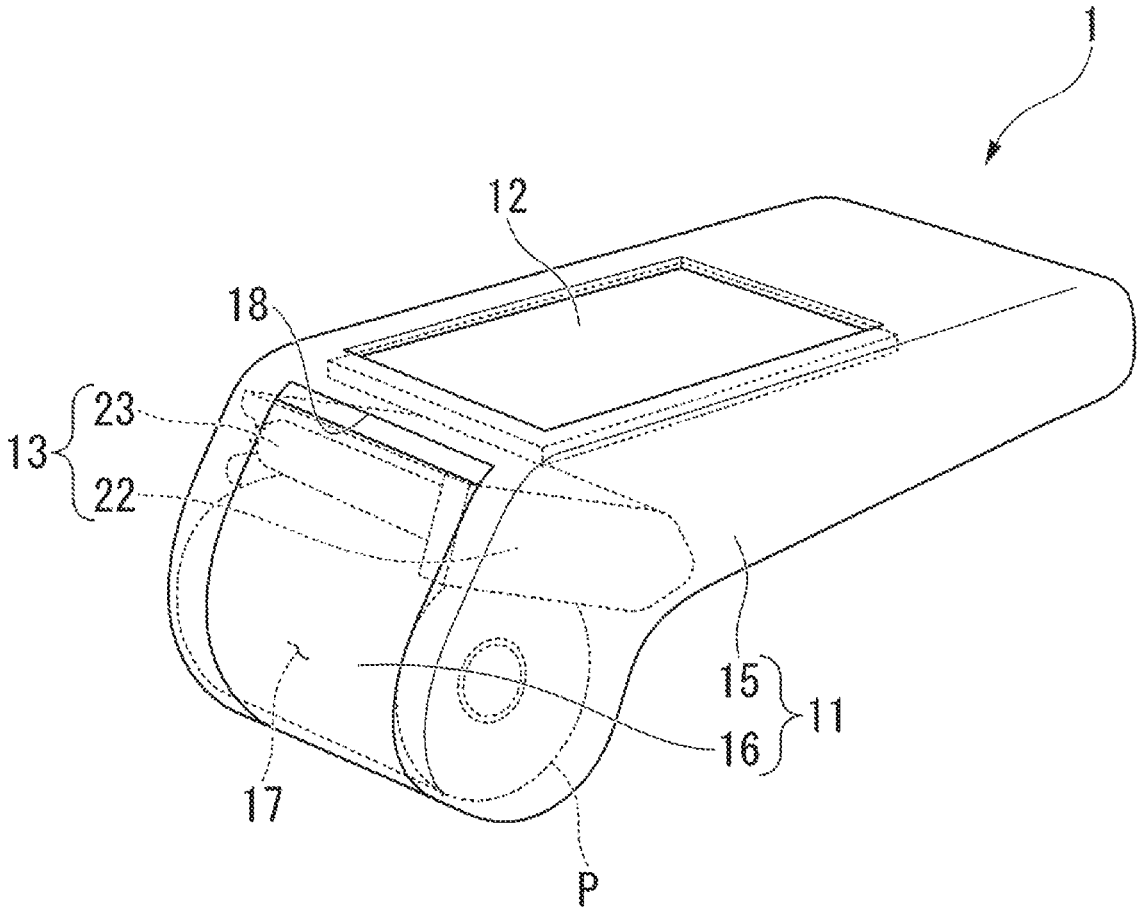
FIG. 1 is a perspective view of a portable terminal according to an embodiment of the present invention.

Now, embodiments of the present invention are described with reference to the accompanying drawings. FIG. 1 is a perspective view of a portable terminal 1. As illustrated in FIG. 1, the portable terminal 1 is, for example, a payment terminal which is portable by a user. The portable terminal 1 includes a casing 11, an input display portion 12, and a thermal printer 13.

The casing 11 includes a casing main body 15 and a printer cover 16. The casing main body 15 is formed into a box shape having a rectangular shape in plan view. In a distal end portion of the casing main body 15, there is formed a recording paper receiving portion 17 configured to receive recording paper P (heat-sensitive paper). The recording paper P is received, under a state of being wound into a roll, in the recording paper receiving portion 17. The printer cover 16 is turnably connected to the casing main body 15 through intermediation of a hinge portion (not shown). The printer cover 16 is configured to open and close the recording paper receiving portion 17. In the casing 11, there is formed a discharge port 18, which is configured to discharge the recording paper P to the outside, between an opening edge of the recording paper receiving portion 17 and a distal edge of the printer cover 16. The input display portion 12 is arranged on a front surface of the casing 11. The input display portion 12 is, for example, a touch panel. The input display portion 12 is configured to display various information on a screen and enable operation to the information displayed on the screen.

The thermal printer 13 is mounted at a position adjacent to the discharge port 18 in the casing 11. The thermal printer 13 is configured to print information on the recording paper P, which is fed from the recording paper receiving portion 17, and to discharge the recording paper P through the discharge port 18.

Figure 2:
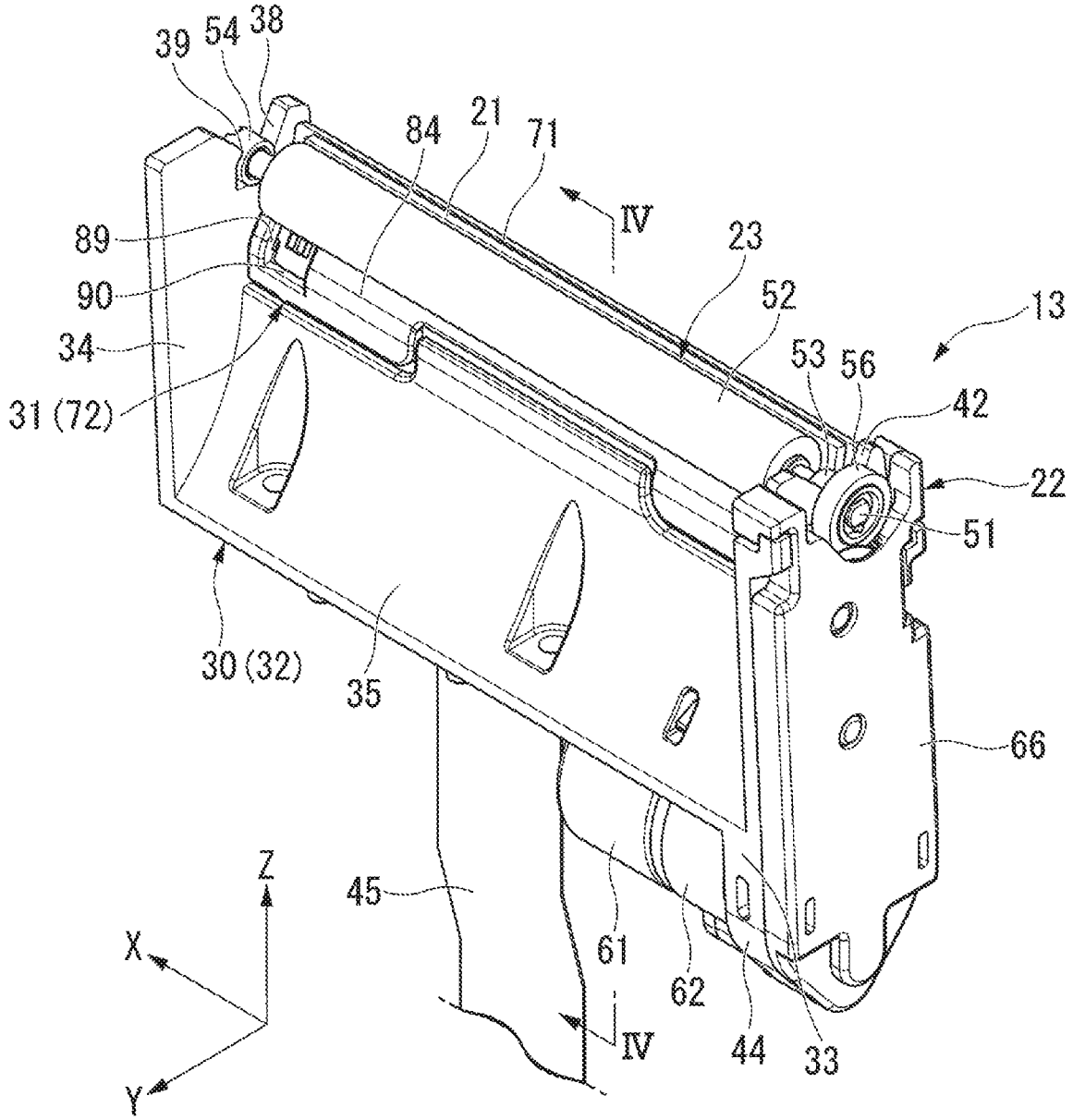
FIG. 2 is a perspective view of a thermal printer according to the embodiment of the present invention.
Figure 3:
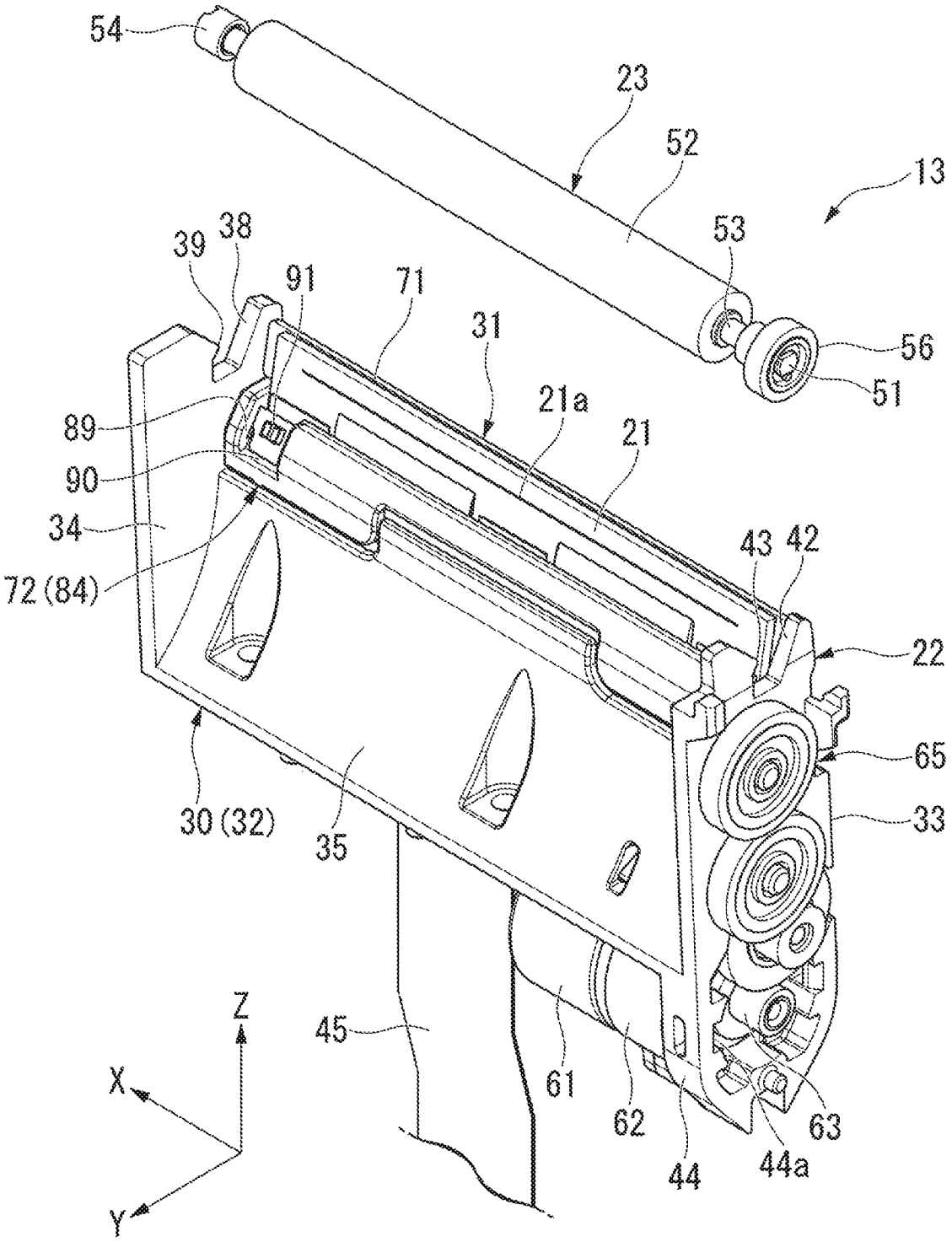
FIG. 3 is an exploded perspective view of the thermal printer according to the embodiment of the present invention.

FIG. 2 is a perspective view of the thermal printer 13. FIG. 3 is an exploded perspective view of the thermal printer 13. As illustrated in FIG. 2 and FIG. 3, the thermal printer 13 includes a head unit 22 and a platen roller 23. The head unit 22 includes a thermal head 21. In the example illustrated in FIG. 1, the head unit 22 is assembled to the casing main body 15. The platen roller 23 is assembled to the printer cover 16, and is rotatably supported by the printer cover 16. The printer cover 16 has a support shaft in a lower portion of FIG. 1, and is opened toward a left front side of FIG. 1. At that time, the platen roller 23 moves to follow the printer cover 16. With this action, connection between the platen roller 23 and the head unit 22 is released so that the recording paper P is brought into a free state. Conversely, when the printer cover 16 is closed, the platen roller 23 also moves to follow the printer cover 16. At this time, the platen roller 23 returns to a position in contact with the thermal head 21. As described above, the head unit 22 and the platen roller 23 are combined so as to be separable along with opening and closing of the printer cover 16. When the printer cover 16 takes a closed position, the head unit 22 and the platen roller 23 are opposed to each other across the above-mentioned discharge port 18. In the following description, an axial direction of the platen roller 23 is described as an X direction (first direction), and two directions orthogonal to the X direction are described as a Y direction (second direction) and a Z direction (third direction). Further, in the following description, in each of the X direction, the Y direction, and the Z direction, a direction indicated by the arrow in the drawings is described as a plus direction, and a direction opposite to the arrow is described as a minus direction.

As illustrated in FIG. 3, the head unit 22 includes a frame 30 and a head block 31 supported on the frame 30. The frame 30 includes a base portion 32, a first side plate portion 33, and a second side plate portion 34. The base portion 32 extends in the X direction. The first side plate portion 33 and the second side plate portion 34 are connected to both end portions of the base portion 32 in the X direction. The base portion 32 includes a guide wall 35 and a back surface plate 36 (see FIG. 4). The guide wall 35 is located in a plus Y direction of the base portion 32. The back surface plate 36 is located in a minus Y direction with respect to the guide wall 35. A surface of the guide wall 35 which is oriented in the plus Y direction constructs a paper passage surface which is configured to guide the recording paper P in the plus Z direction. The paper passage surface is a curved surface which protrudes in the minus Y direction.

Figure 4:
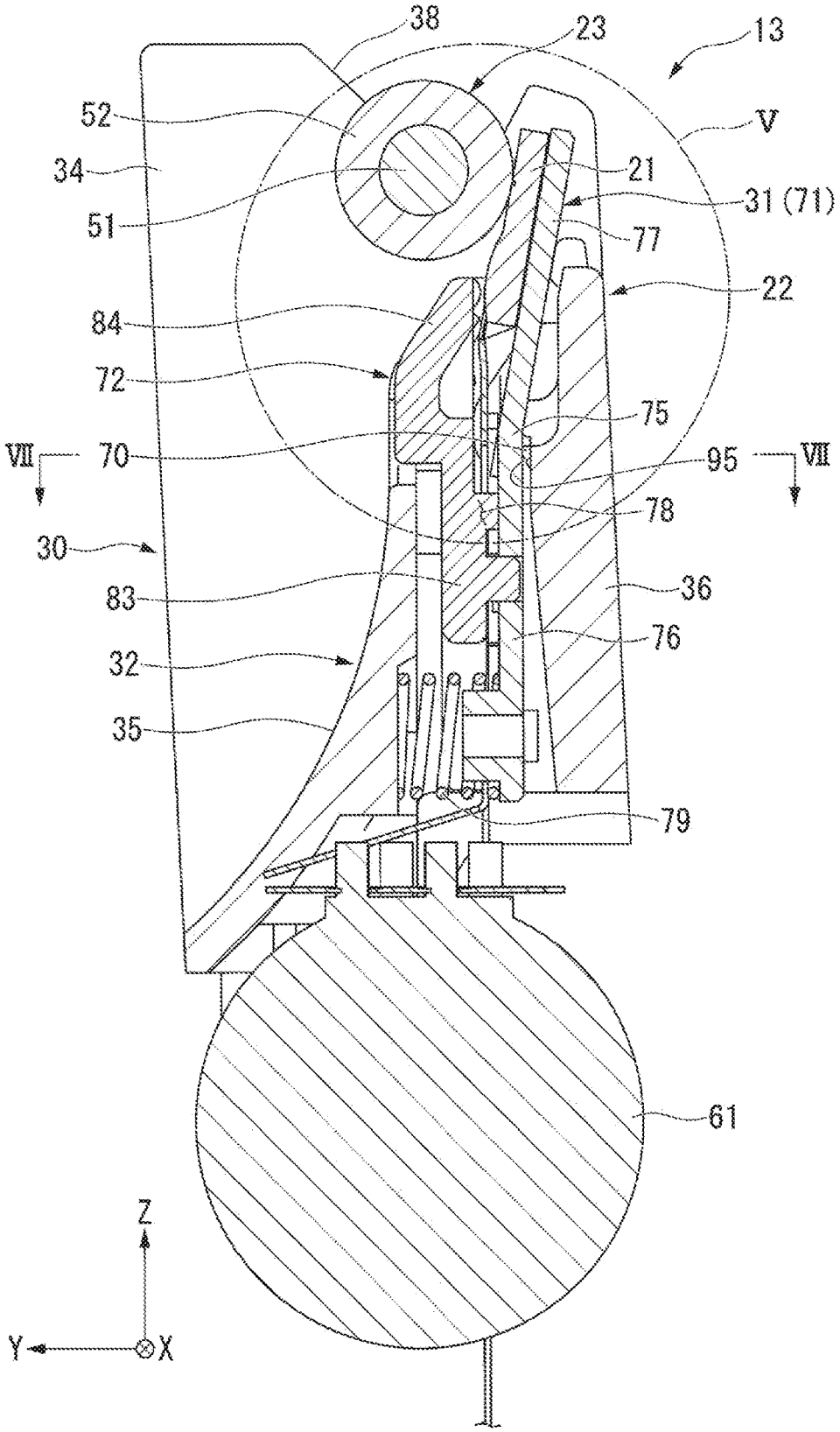
FIG. 4 is a sectional view taken along the line IV-IV of FIG. 2.

FIG. 4 is a sectional view taken along the line IV-IV of FIG. 2. As illustrated in FIG. 4, the back surface plate 36 is arranged so as to be opposed to the guide wall 35 at an interval in the Y direction.

As illustrated in FIG. 3, the second side plate portion 34 is connected to an end portion of the base portion 32, which includes the guide wall 35 and the back surface plate 36, in a plus X direction. At a portion of the second side plate portion 34 which protrudes in the plus Z direction with respect to the base portion 32, a second roller receiving groove 38 is formed. The second roller receiving groove 38 is formed so as to recess in the minus Z direction from an end edge of the second side plate portion 34 in the plus Z direction. At a portion of an inner peripheral edge of the second roller receiving groove 38 which is located in the plus Y direction, there is formed a second hook portion 39 which protrudes in the minus Y direction.

The first side plate portion 33 is connected to the end portion of the base portion 32 in a minus X direction. At a portion of the first side plate portion 33, which protrudes in the plus Z direction with respect to the base portion 32, there is formed a first roller receiving groove 42. The first roller receiving groove 42 is formed so as to recess in the minus Z direction from an end edge of the first side plate portion 33 in the plus Z direction. At a portion of an inner peripheral edge of the first roller receiving groove 42 which is located in the plus Y direction, there is formed a first hook portion 43 which protrudes in the minus Y direction. A portion of the first side plate portion 33 which protrudes in the minus Z direction with respect to the base portion 32 constructs a motor support portion 44.

The platen roller 23 nips the recording paper P with the thermal head 21 to convey the recording paper P toward the discharge port 18. Specifically, the platen roller 23 includes a platen shaft 51 and a roller main body 52. The platen shaft 51 extends in the X direction. At both end portions of the platen shaft 51 in the X direction, there are mounted a first bearing 53 and a second bearing 54, respectively. The bearings 53 and 54 are retained in the above-mentioned roller receiving grooves 38 and 42, respectively. With this, the platen roller 23 is supported on the frame 30 so as to be rotatable about an axis extending in the X direction and so as to be removable from the frame 30. The roller portions of the frame 30, which are configured to rotatably support the platen roller 23, are not limited to the roller receiving grooves 38 and 42.

At a portion of the platen shaft 51 which is located in the minus X direction with respect to the first platen shaft 53, there is arranged a driven gear (transmission portion) 56. Under a state in which the platen roller 23 is retained in the roller receiving grooves 38 and 42, the driven gear 56 is positioned in the minus X direction from the first side plate portion 33.

The roller main body 52 is made of, for example, rubber. The roller main body 52 is externally mounted to a portion of the platen shaft 51 other than the both end portions of the platen shaft 51 in the X direction. An outer peripheral surface of the roller main body 52 is held in contact with the above-mentioned thermal head 21.

At a portion of the above-mentioned frame 30 which is located in the plus X direction with respect to the motor support portion 44, there is arranged a motor (drive source) 61. The motor 61 is arranged under a state in which a rotary shaft (not shown) thereof protrudes in the minus X direction. The motor 61 is connected to the controller through intermediation of a flexible board 45 or the like.

Between the motor 61 and the motor support portion 44 in the X direction, there is arranged a first speed reduction mechanism 62 configured to reduce power of the motor 61. The first speed reduction mechanism 62 is, for example, a planetary gear mechanism. The first speed reduction mechanism 62 has an output gear 63 which protrudes in the minus X direction. The output gear 63 protrudes through a through hole 44*a*, which is formed in the motor support portion 44, in the minus X direction with respect to the motor support portion 44.

At a portion which is located in the minus X direction with respect to the above-mentioned first side plate portion 33, there is arranged a second speed reduction mechanism 65. The second speed reduction mechanism 65 is a gear train mechanism including a two-step gear. The second speed reduction mechanism 65 provides connection between the output gear 63 of the first speed reduction mechanism 62 and a driven gear 56 of the platen roller 23. As illustrated in FIG. 2, the second speed reduction mechanism 65 is covered with a gear cover 66 from the minus X direction.

Figure 5:
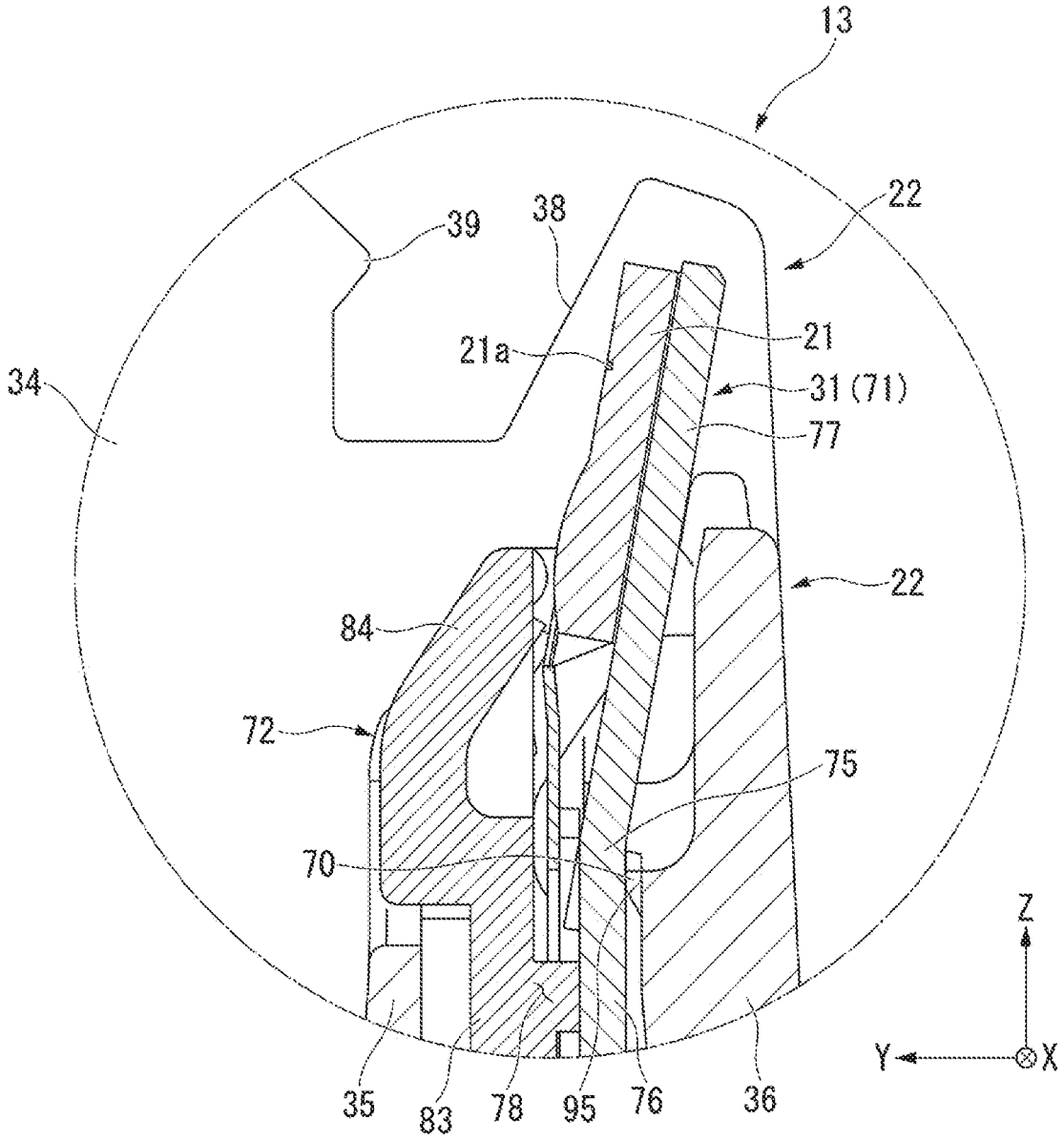
FIG. 5 is an enlarged sectional view corresponding to the portion V of FIG. 4.
Figure 6:
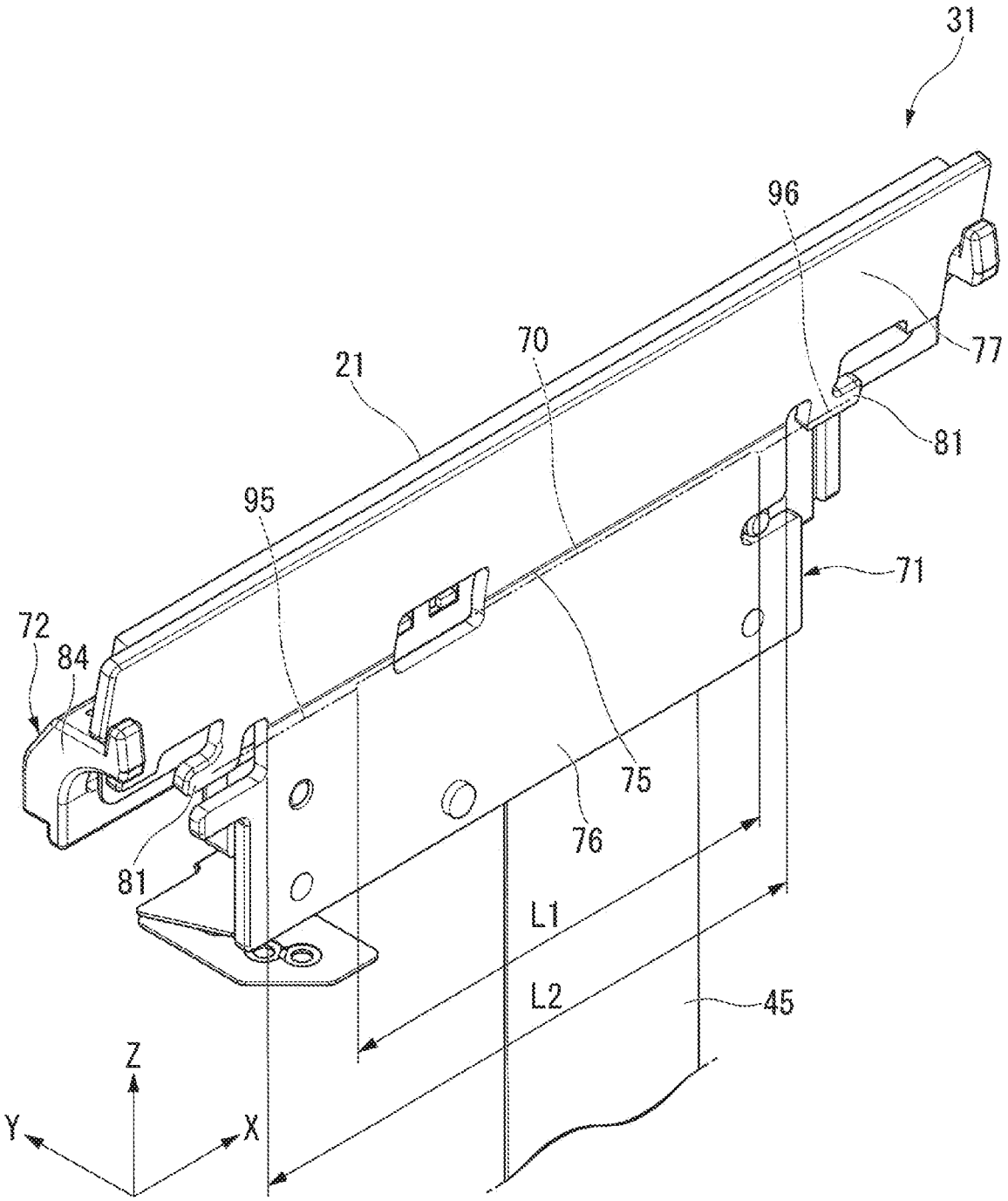
FIG. 6 is a perspective view for illustrating a head block as seen from a minus Y direction.

FIG. 5 is an enlarged sectional view corresponding to the portion V of FIG. 4. FIG. 6 is a perspective view for illustrating the head block 31 as seen from the minus Y direction. As illustrated in FIG. 5 and FIG. 6, the head block 31 mainly includes a head support plate 71, a sensor holder 72 supported on the head support plate 71, and the above-mentioned thermal head 21.

The head support plate 71 has a plate-like shape having a thickness direction in the Y direction. The head support plate 71 is supported so as to be swingable about the X direction and the Z direction at a support portion (swing support portion) 70 formed on the back surface plate 36 as a support point. A configuration of the support portion 70 is described later in detail.

The head support plate 71 includes a bent portion 75, an urging portion 76, and a head mounting portion 77. The bent portion 75 is located at a center portion of the head support plate 71 in the Z direction. The urging portion 76 is located in the minus Z direction with respect to the bent portion 75. The head mounting portion 77 is located in the plus Z direction with respect to the bent portion 75. The bent portion 75 is bent so as to cause the head support plate 71 to protrude in the plus Y direction. The bent portion 75 linearly extends over an entire region of the head support plate 71 in the X direction.

As illustrated in FIG. 4, the urging portion 76 is arranged in an assembly hole 78 of the above-mentioned base portion 32, which is defined by the guide wall 35 and the back surface plate 36. Urging members 79 are interposed between an end portion of the urging portion 76 in the minus Z direction and the guide wall 35.

The urging members 79 are cylindrical coil springs each having an axial direction in the Y direction. The urging members 79 urge the urging portion 76 and the guide wall 35 in a direction of separating the urging portion 76 and the guide wall 35 from each other in the Y direction. In this embodiment, the urging members 79 are provided at two locations apart from each other in the X direction. In the assembly hole 78, the above-mentioned flexible board 45 is drawn out in the Z direction from a position between the urging members 79 adjacent to each other in the X direction. However, for example, the number or layout of the urging members 79 can suitably be changed. The urging members 79 are not limited to the cylindrical coil springs. There may be used conical coil springs, leaf springs, or the like as the urging members 79.

As illustrated in FIG. 5 and FIG. 6, the head mounting portion 77 continues from the bent portion 75 in the plus Z direction. The head mounting portion 77 has a width in the X direction larger than those of the above-mentioned bent portion 75 and urging portion 76. At both end portions of the head mounting portion 77 in the X direction, engagement portions 81 (see FIG. 6) are continuously formed. The engagement portions 81 are engaged, at least in the Z direction, with engaged portions (not shown) formed in the frame 30. With this, movement of the head block 31 with respect to the frame 30 in the Z direction is regulated. The shape of the head support plate 71 may be changed as appropriate. For example, the entire head support plate 71 may be formed linearly, specifically, may be formed to have a shape without the bent portion 75.

As illustrated in FIG. 3 and FIG. 4, the thermal head 21 is attached and fixed to the above-mentioned head mounting portion 77 from the plus Y direction. The thermal head 21 has a plate-like shape extending in the X direction. On a surface (hereinafter referred to as "head surface") of the thermal head 21, which is oriented in the plus Y direction, a plurality of heating elements 21*a* (see FIG. 5) are arrayed in the X direction at intervals. The head surface of the thermal head 21 is brought into press-contact with an outer peripheral surface of the platen roller 23 (roller main body 52) by urging force of the above-mentioned urging members 79.

With this action, the platen roller 23 is assembled to the frame 30 under a state in which the roller main body 52 is pressed by the head block 31 in the plus Y direction so that the bearings 53 and 54 are engaged with corresponding hook portions 39 and 43 in the roller receiving grooves 38 and 42 from the minus Z direction. That is, in this embodiment, the platen roller 23 is assembled to the frame 30 by the groove shapes of the roller receiving grooves 38 and 42 and the pressing force of the head block 31. Then, the above-mentioned recording paper P is conveyed by rotation of the platen roller 23 under a state in which the recording paper P is nipped between the head surface of the thermal head 21 and the outer peripheral surface of the roller main body 52. In this embodiment, under a state in which the head unit 22 and the platen roller 23 are combined with each other, the head surface of the thermal head 21 is arranged so as to be inclined in the Z direction, specifically, so as to extend in the minus Y direction toward the plus Z direction.

The thermal head 21 is connected to, for example, a controller (not shown) through the flexible board 45. In the thermal head 21, heat generation of the heating elements 21*a* is controlled by a driver IC (not shown) mounted to the thermal head 21 in accordance with a signal transmitted from the controller. When the recording paper P passes through the heating elements 21*a*, printing on the recording paper P is performed.

The sensor holder 72 is assembled to the head support plate 71 from the plus Y direction. Specifically, the sensor holder 72 includes a mounting portion 83 (see FIG. 4) and a cover portion 84 which continues from the mounting portion 83 in the plus Z direction. The mounting portion 83 is assembled to the above-mentioned urging portion 76 at a portion located in the plus Z direction with respect to the urging members 79 in the assembly hole 78. That is, the sensor holder 72 is swingable together with the head support plate 71 with respect to the frame 30.

The cover portion 84 is located in the plus Z direction with respect to the guide wall 35. The cover portion 84 extends in the plus Y direction from an end edge of the mounting portion 83 in the plus Z direction and then extends in the plus Z direction. A surface of the cover portion 84 which is oriented in the plus Y direction forms a guide surface configured to guide the recording paper P to the thermal head 21. The guide surface smoothly connects a paper passage surface of the guide wall 35 and the head surface of the thermal head 21 to each other.

As illustrated in FIG. 3, at an end portion of the cover portion 84 in the plus X direction, there is formed a passing hole 89 which penetrates through the cover portion 84. At a portion of an opening edge of the passing hole 89, which is located in the minus Z direction, there is formed a seat portion 90 which protrudes in the minus Y direction. A recording paper sensor 91 is supported on the seat portion 90. The recording paper sensor 91 is, for example, a PI sensor of a reflection type. The recording paper sensor 91 includes a light emitter and a light receiver. Light emitted from the light emitter is reflected on the recording paper P, and the reflected light can be detected by the light receiver. The recording paper sensor 91 is connected to the controller through the flexible board 45. When the reflected light is detected by the light receiver of the recording paper sensor 91, the controller determines that the recording paper P is present within a detection range of the recording paper sensor 91.

Figure 7:
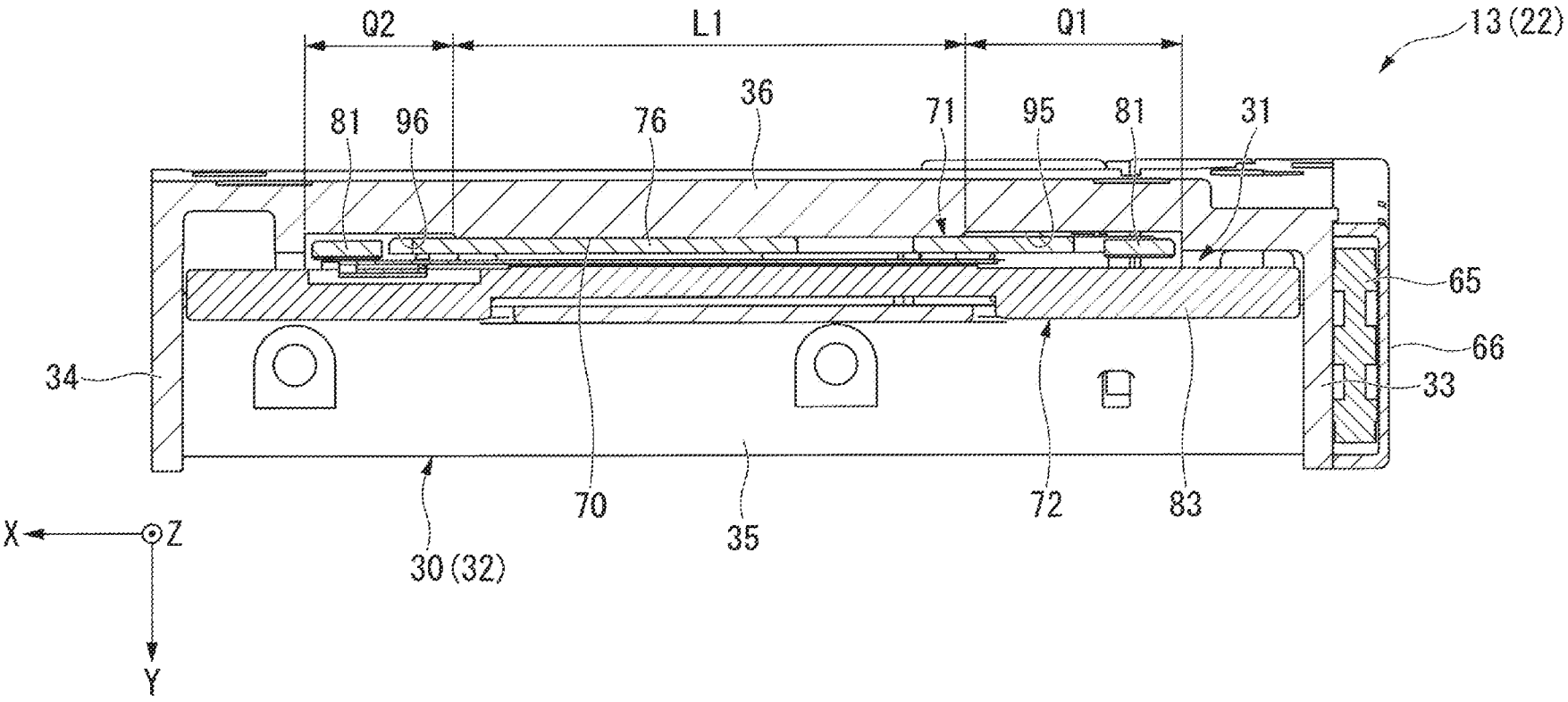
FIG. 7 is a sectional view taken along the line VII-VII of FIG. 4.

FIG. 7 is a sectional view taken along the line VII-VII of FIG. 4. As illustrated in FIG. 5 to FIG. 7, the above-mentioned support portion 70 protrudes in the plus Y direction from the end portion of the back surface plate (base portion) 36 in the plus Z direction. Specifically, the support portion 70 extends in the X direction in a region other than the both end portions of the back surface plate 36 in the X direction (center portion in the X direction). The support portion 70 is held in abutment against an end portion of the urging portion 76 of the head support plate 71 in the plus Z direction from the minus Y direction. With this configuration, the head support plate 71 is swingable about the X direction with the support portion 70 as a support point. The abutment position of the support portion 70 with respect to the head support plate 71 may be, for example, at the bent portion 75 or the head mounting portion 77.

As illustrated in FIG. 6, a length L1 of the support portion 70 in the X direction is smaller than a length L2 of the head support plate 71 at the abutment portion with respect to the support portion 70 in the X direction (length of the urging portion 76 in this embodiment). Therefore, as illustrated in FIG. 6 and FIG. 7, both end portions of the urging portion 76 in the X direction are not held in abutment against the support portion 70. Thus, the head support plate 71 is swingable about the Z direction, for example, at the end portion of the support portion 70 in the minus X direction as a support point. That is, the head support plate 71 in this embodiment is supported by the support portion 70 so as to be swingable about the X direction and the Z direction. It is preferred that the length L1 of the support portion 70 in the X direction be set equal to or larger than a half of the length L2 of the head support plate 71 in the X direction. However, the support portion 70 is only required to be held in abutment against at least a part of the head support plate 71.

In the frame 30, on both end portions in the X direction with respect to the support portion 70, there are formed relief portions (first relief portion 95 and second relief portion 96) which are recessed in the minus Y direction with respect to the support portion 70. The relief portions 95 and 96 are formed so as to avoid contact with the back surface plate 36 when the head support plate 71 swings about the Z direction. In this embodiment, the above-mentioned urging members 79 are arranged at positions corresponding to positions of the relief portions 95 and 96 in the X direction.

As illustrated in FIG. 7, a length Q1 of the first relief portion 95 in the X direction is larger than a length Q2 of the second relief portion 96 in the X direction. Thus, the support portion 70 is formed so as to be asymmetrical over a center of the urging portion 76 in the X direction. However, the length of each of the relief portions 95 and 96 in the X direction can suitably be changed.

Next, description is made of actions of the thermal printer 13 and the portable terminal 1 according to this embodiment. In the following description, first, an operation of the head support plate 71 at the time of mounting and removing the platen roller 23 is described. As illustrated in FIG. 4 and FIG. 5, at the time of performing an operation of closing the printer cover 16, the roller main body 52 of the platen roller 23 presses the head support plate 71 in the minus Y direction through intermediation of the thermal head 21. Then, the head support plate 71 turns about the X direction in a direction against an urging force of the urging members 79 (direction of causing the head mounting portion 77 to move in the minus Y direction) at the contact portion with respect to the support portion 70 as a support point. With this action, the bearings 53 and 54 of the platen roller 23 enter the roller receiving grooves 38 and 42, respectively.

Then, when the bearings 53 and 54 of the platen roller 23 proceed over the top portions of the hook portions 39 and 43, the head support plate 71 turns about the X direction in a direction of restoring the urging members 79 (direction of causing the head mounting portion 77 to move in the plus Y direction) at the contact portion with respect to the support portion 70 as a support point. With this action, the platen roller 23 is assembled to the frame 30 by a restoring force of the head support plate 71 under a state in which the platen roller 23 is pressed by the thermal head 21 in the plus Y direction. At this time, the hook portions 39 and 43 are engaged with the bearings 53 and 54 of the platen roller 23 from the plus Z direction, thereby regulating the movement of the platen roller 23 in the plus Z direction with respect to the frame 30. At the time of performing an operation of opening the printer cover 16, an operation reverse to the above-mentioned operation is performed.

Next, an operation method of the above-mentioned portable terminal 1 is described. In the following description, it is assumed that a leading edge of the recording paper P is nipped between the platen roller 23 and the thermal head 21. In the portable terminal 1, printing on the recording paper P is started through operation to the input display portion 12. Specifically, a signal is output from the controller to the motor 61 through, for example, the flexible board 45, with the result that the motor 61 rotates. The power of the motor 61 is reduced by the first speed reduction mechanism 62 and the second speed reduction mechanism 65 and thereafter is transmitted to the driven gear 56. With this, the platen roller 23 is rotated. Then, the recording paper P nipped between the outer peripheral surface of the platen roller 23 and the thermal head 21 is delivered toward the discharge port 18.

When the signal is output from the controller to the thermal head 21 through the flexible board 45 during the course of delivering the recording paper P through rotation of the platen roller 23, the heating elements 21*a* of the thermal head 21 generate heat as appropriate. With this, various information is printed on the recording paper P. Then, the recording paper P discharged through the discharge port 18 is cut and used as, for example, a receipt.

Incidentally, at the time of performing a printing operation of the thermal printer 13, power of the motor 61 is transmitted to the platen roller 23 through the driven gear 56 as mentioned above. At this time, a component force of a rotational force transmitted from the second speed reduction mechanism 65 to the driven gear 56 acts on the platen roller 23 in the minus Y direction (hereinafter referred to as "Y-direction component force").

When the Y-direction component force is larger than the urging force of the urging members 79, there is a fear in that an action of pressing back the head block 31 through intermediation of the thermal head 21 in the minus Y direction (direction against the urging force of the urging members 79) causes the bearings 53 and 54 to move in the minus Y direction in the roller receiving grooves 38 and 42. At this time, the Y-direction component force is reduced as separating from the driven gear 56 (as proceeding from the minus X direction to the plus X direction). Accordingly, the movement amount of the end portion of the platen roller 23 in the minus X direction (bearing 53 side) becomes larger than the movement amount of the end portion of the platen roller 23 in the plus X direction (bearing 54 side). As a result, there is a fear in that the platen roller 23 is held with inclination in a state of extending in the plus Y direction as proceeding from the minus X direction to the plus X direction. In this case, a load which acts between the thermal head 21 and the roller main body 52 becomes uneven in the X direction. Then, the width of the nip portion of the roller main body 52 becomes uneven.

Therefore, in this embodiment, there is employed a configuration in which the head block 31 is swingable about the Z direction with the support portion 70 as the support point. With this configuration, in accordance with the load in the Y direction which acts between the platen roller 23 and the thermal head 21, the head block 31 swings about the Z direction. Specifically, the platen roller 23 is inclined in a state of extending in the plus Y direction as proceeding from the minus X direction to the plus X direction. Thus, the head block 31 swings with the end edge of the support portion 70 in the minus X direction as a support point. With this configuration, the head block 31 extends so as to correspond to the inclination of the platen roller 23. Thus, the load which acts between the thermal head 21 and the roller main body 52 becomes more likely to be even over the entirety in the X direction. As a result, the width of the nip portion of the roller main body 52 can easily be maintained so as to be uniform over the entirety in the X direction (the entirety of the portion opposed to the heating portion in which the heating elements 21*a* are arrayed). Further, in this embodiment, the width of the nip portion can be maintained so as to be uniform by the swing of the head block 31, and hence it is not necessary to hold the platen roller 23 on the frame 30 with use of, for example, the lock arm. Therefore, reduction in cost and simplification of configuration can be achieved. As a result, the thermal printer 13 which is excellent in print quality while achieving reduction in cost and simplification of configuration can be provided.

Further, it is also not necessary to increase a diameter of the roller main body 52 or increase the size of the motor 61 to secure the width of the nip portion, thereby being capable of achieving reduction in size of the thermal printer 13.

In this embodiment, the support portion 70 protrudes in the plus Y direction from the back surface plate 36, thereby being capable of using the portion located in the minus X direction with respect to the support portion 70 as the first relief portion 95 for avoiding contact between the frame 30 and the head support plate 71. With this configuration, the head block 31 can easily swing so as to correspond to the inclination of the platen roller 23. As a result, the width of the nip portion can easily be maintained so as to be uniform over the entirety in the X direction.

In this embodiment, the second relief portion 96 is formed at the portion located in the plus X direction with respect to the support portion 70, thereby being capable of achieving, for example, reduction in material cost and reduction in weight. Further, in this embodiment, the length Q1 of the first relief portion 95 is larger than the length Q2 of the second relief portion 96. Therefore, the end portion of the heat block 31 in the minus X direction can be positively inclined in the minus Y direction by the load which acts between the roller main body 52 and the thermal head 21.

In this embodiment, the length L1 of the support portion 70 is smaller than the length L2 of the head support plate 71. With this configuration, under a state in which the head block 31 is not inclined about the Z direction, such as at the time of not printing (for example, at the time of mounting or removing the platen roller 23), the contact region between the support portion 70 and the head support plate 71 can be secured. As a result, the head support plate 71 can be stably supported by the support portion 70.

Further, the portable terminal 1 according to this embodiment includes the above-mentioned thermal printer 13. Therefore, the portable terminal 1 which is excellent in print quality while achieving reduction in cost and simplification of configuration can be provided.

Note that, the technical scope of the present invention is not limited to the above-mentioned embodiments, but various modifications may be made without departing from the gist of the present invention.

In the above-mentioned embodiments, description is made of the case where the payment terminal is used as one example of the portable terminal 1. However, not limited to this configuration, the configuration of the present invention may be applied to various types of portable terminals.

In the above-mentioned embodiment, description is made of the configuration in which the support portion 70 extends along the X direction. However, the present invention is not limited to this configuration as long as the head block 31 is swingable about the Z direction. The support portion 70 may be formed intermittently in the X direction. In the above-mentioned embodiment, description is made of the configuration in which the relief portions 95 and 96 are formed on both sides in the X direction with respect to the support portion 70. However, the present invention is not limited to this configuration. It is only necessary that at least the first relief portion 95 (relief portion close to the driven gear 56) be provided. In the above-mentioned embodiment, description is made of the configuration in which the support portion 70 is formed so as to be asymmetrical over the center of the urging portion 76 in the X direction. However, the present invention is not limited to this configuration.

Besides the above, the components in the above-mentioned embodiments may be replaced by well-known components as appropriate without departing from the gist of the present invention. The above-mentioned modified examples may be combined with each other as appropriate.

What is claimed is:

1. A thermal printer, comprising:

a frame;

a platen roller, which is supported on the frame so as to be rotatable about a first direction, and includes a transmission portion configured to receive power transmitted from a drive source at an end portion on a first side in the first direction;

a head support plate, which is supported on the frame; and a thermal head, which is fixed to the head support plate, and is configured to nip recording paper between the thermal head and the platen roller in a second direction orthogonal to the first direction to perform printing on the recording paper, wherein the frame includes a swing support portion configured to support the head support plate so that the head support plate is swingable about the first direction and a third direction orthogonal to the first direction and the second direction, wherein the thermal head is fixed to a portion of the head support plate located on a first side in the third direction with respect to the swing support portion, and wherein an urging member configured to urge the head support plate in a direction of causing the thermal head to approach the platen roller is interposed between a portion of the head support plate located on a second side in the third direction with respect to the swing support portion, and the frame.

2. A thermal printer according to claim 1, wherein the frame includes:

a base portion; and the swing support portion, which protrudes in the second direction from a portion of the base portion located on a side opposite to the platen roller over the head support plate, and wherein a relief portion for avoiding contact between the head support plate and the base portion along with swinging of the head support plate about the third direction is formed at a portion of the frame located at least on the first side in the first direction with respect to the swing support portion.

3. A thermal printer according to claim 1, wherein a length of the swing support portion in the first direction is set equal to or larger than a half of a length of the head support plate in the first direction.

4. A portable terminal, comprising:

the thermal printer of claim 1; and a casing to which the thermal printer is mounted.

* * * * *